US006006573A

United States Patent [19]

Van Merksteijn

[11] Patent Number: 6,006,573

[45] **Date of Patent: *Dec. 28, 1999**

[54] DRIVEN DUCTILITY MACHINE

[76] Inventor: Jacobus Lambertus Van Merksteijn, Veldolenweg 10, NL-7491 GN Delden, Netherlands

[ * ] Notice: This patent issued on a continued prosecution application filed under 37 CFR 1.53(d), and is subject to the twenty year patent term provisions of 35 U.S.C. 154(a)(2).

[21] Appl. No.: 08/853,571

[22] Filed: May 9, 1997

[30] Foreign Application Priority Data

May 10, 1996 [NL] Netherlands ..... 1003078

[51] Int. Cl.[6] ..... B21F 1/04

[52] U.S. Cl. ..... 72/160

[58] Field of Search ..... 72/160, 163, 164, 72/10.3

[56] References Cited

U.S. PATENT DOCUMENTS

| | | | |
|---|---|---|---|
| 1,824,568 | 9/1931 | Pierce . | |
| 2,332,796 | 10/1943 | Hume | 72/160 |
| 3,247,946 | 4/1966 | Klein | 72/160 |
| 3,253,445 | 5/1966 | Franek | 72/164 |
| 3,326,025 | 6/1967 | Nishioka | 72/161 |
| 3,389,591 | 6/1968 | Moline | 72/160 |
| 3,394,574 | 7/1968 | Franek | 72/164 |
| 3,605,470 | 9/1971 | Polakowski | 72/164 |
| 3,777,532 | 12/1973 | Noe | 72/160 |
| 3,798,950 | 3/1974 | Franek | 72/163 |
| 3,964,848 | 6/1976 | Wockener | 72/160 |
| 5,611,190 | 3/1997 | Van Merksteijn | 52/740.3 |

FOREIGN PATENT DOCUMENTS

| | | | |
|---|---|---|---|
| 86320 | 4/1991 | Japan | 72/160 |
| 1150166 | 4/1969 | United Kingdom . | |
| 2214846 | 9/1989 | United Kingdom . | |

*Primary Examiner*—Daniel C. Crane
*Attorney, Agent, or Firm*—Webb Ziesenheim Logsdon Orkin & Hanson, P.C.

[57] ABSTRACT

A cold flow unit for metal wire is disclosed having at least three successive rollers, wherein the metal wire is trained over a part of the roller periphery such that at the transition of the metal wire from one roller to the subsequent roller the transition distance between the points of contact is less than 5 times the metal wire diameter. A device is disclosed for processing metal wire, having a roller cassette and subsequent thereto at least one such cold flow unit, or having at least two successive such cold flow units.

11 Claims, 4 Drawing Sheets

DRIVEN DUCTILITY MACHINE

BACKGROUND OF THE INVENTION

The present invention relates to a cold flow unit for metal wire for the purpose of improving the tensile strength and increasing the ductility of the metal wire and, in other words, to provide the wire with optimum properties for further use.

SUMMARY OF THE INVENTION

The present invention is based on the insight that by causing a metal wire to transfer practically immediately successively from a positive radius to a negative radius and vice versa, cold flow occurs whereby the above mentioned properties improve. By causing this transition in radius to take place a number of times not only is an improvement of the properties obtained but such a cold flow unit can likewise be used to transport the metal wire during processing.

The transition in the radius must preferably take place directly in view of the length of the metal wire. However, cold flow occurs if the transition distance between the points of contact, i.e. likewise the transition in the radius, is less than 5 times the metal wire diameter. Better cold flow is obtained if this transition distance is less than 4 times, preferably less than 3 times the metal wire diameter. Very good cold flow is obtained at a transition distance less than 2.5 times the metal wire diameter.

Although sufficient cold flow treatments are obtained to acquire improved properties by making use of only three rollers, the improvement in properties can increase further by using more than 3 rollers, for instance at least 4 and more preferably at least 5.

It is possible that the wire is further stretched between the rollers and that the tension in the wire therefore decreases. It is recommended in that case that there is friction contact in the cold flow unit between a roller and the metal wire.

If the cold flow unit is used in a device in which the wire is further processed in units which employ a discontinuous wire processing, such as during aligning of the wire and performing of welding operations thereon, it is recommended to continuously adapt the delivery speed of the cold flow unit with a view to these further devices. For this purpose the cold flow unit is preferably provided with a rotation speed control for each roller in order to control a roller rotation speed subject to the desired delivery speed of the processed metal wire.

A sensor preferably for use therein measures the sagging of the metal wire between the cold flow unit and the subsequent processing unit and this sensor then actuates the rotation speed control.

Another aspect of the present invention relates to a device for processing metal wire, which device contains in addition to the above mentioned cold flow unit according to the invention a roller cassette. It is otherwise also possible to first perform a thinning operation on the metal wire and optionally a profile-arranging operation and subsequently to cause the cold flow to take place in the cold flow unit according to the invention. Transporting means for transport from the metal wire delivery into the cold flow unit can then for instance be dispensed with and metal wire stretching can take place between the devices.

According to another aspect of the present invention, two successive cold flow units are used. Depending on the fact of whether or not the first cold flow unit is driven, the transport between the two units takes place with or without stretching. It is thus possible to obtain metal wire with optimum properties.

BRIEF DESCRIPTION OF THE DRAWINGS

Mentioned and other features of the cold flow unit and the device for processing metal wire, which both embody the invention, will be further elucidated herein-below on the basis of two embodiments which are only given by way of example without the invention being deemed limited thereto. Reference is herein made to the annexed drawings, in which.

DESCRIPTION OF THE PREFERRED EMBODIMENT

Figure 1:
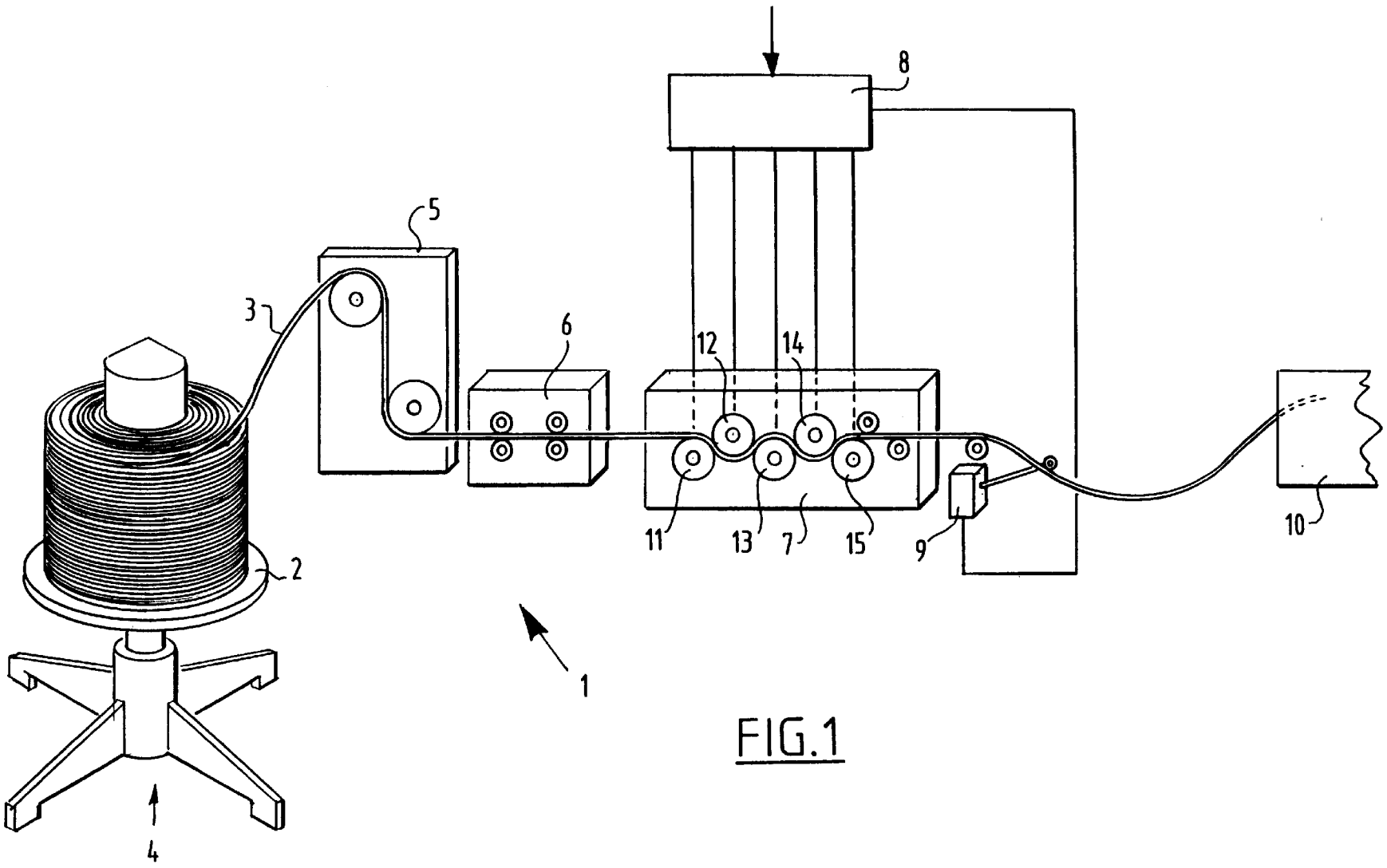
FIG. 1 shows a schematic view of a device for processing metal wire.

FIG. 1 shows a device 1 according to the invention. The processing device 1 comprises a reel 2 for supplying metal wire from a supply location 4. The metal wire 3 is fed via a guide unit 5 to a roller cassette 6 in which an aligning and profiling operation is performed on metal wire 3. Such a roller cassette 6 is described in the European patent application 601,630 which is herein incorporated by reference.

From the roller cassette 6 the metal wire 3 reaches the cold flow unit 7 according to the invention. The delivery speed of cold flow unit 7 is controlled using a rotation speed control 8 which is actuated with a sensor 9. The metal wire 3 eventually reaches a unit 10 for straightening the wire, cutting the wire and/or optionally welding the wire.

Figure 2:
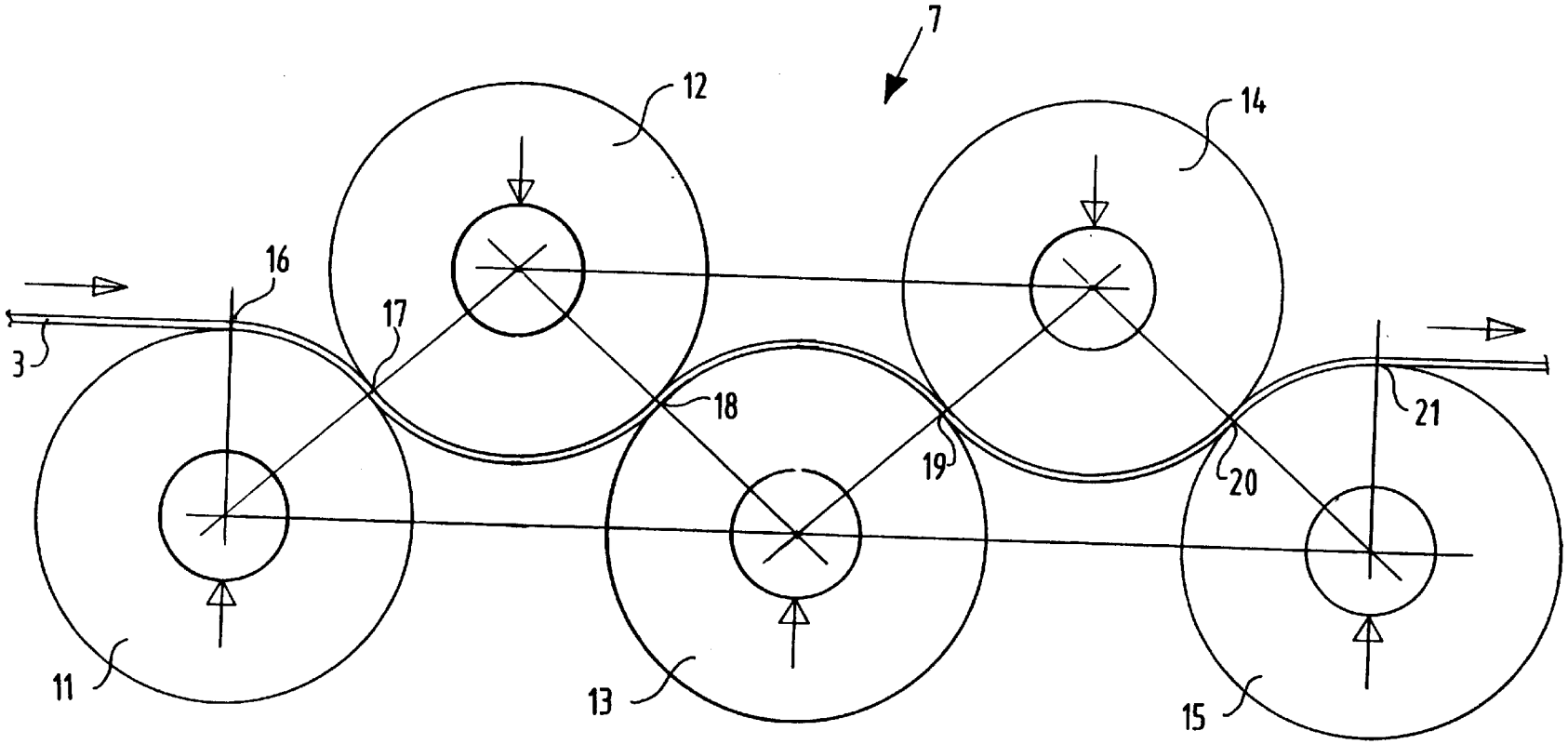
FIG. 2 shows schematically on larger scale a cold flow unit according to the invention used in the device of FIG. 1.

FIG. 2 shows in more detail the structure of cold flow unit 7. Cold flow unit 7 comprises 5 rollers 11–15, over a part of the roller periphery of which the metal wire 3 is trained. The rollers 11–15 are herein mutually oriented such that in this case the transition distance between the points of contact during the transfer of metal wire 3 from the one roller 11 to the following roller 12 does not exceed a determined magnitude. In FIG. 2 the transition distances at the position of the contact points 17–20 are zero. At the position of contact points 17–20 the metal wire is thus subjected to an almost direct transition from a positive to a negative radius or vice versa.

The points of contact 16 and 21 indicate the locations where the metal wire is trained onto roller 11 and respectively leaves roller 15.

It will be apparent that rollers 11–15 are placed in a frame such that a friction contact is possible between metal wire and roller and that during passage of the wire through cold flow unit 7 the tension in the metal wire decreases but the stretch improves optimally.

Figure 3:
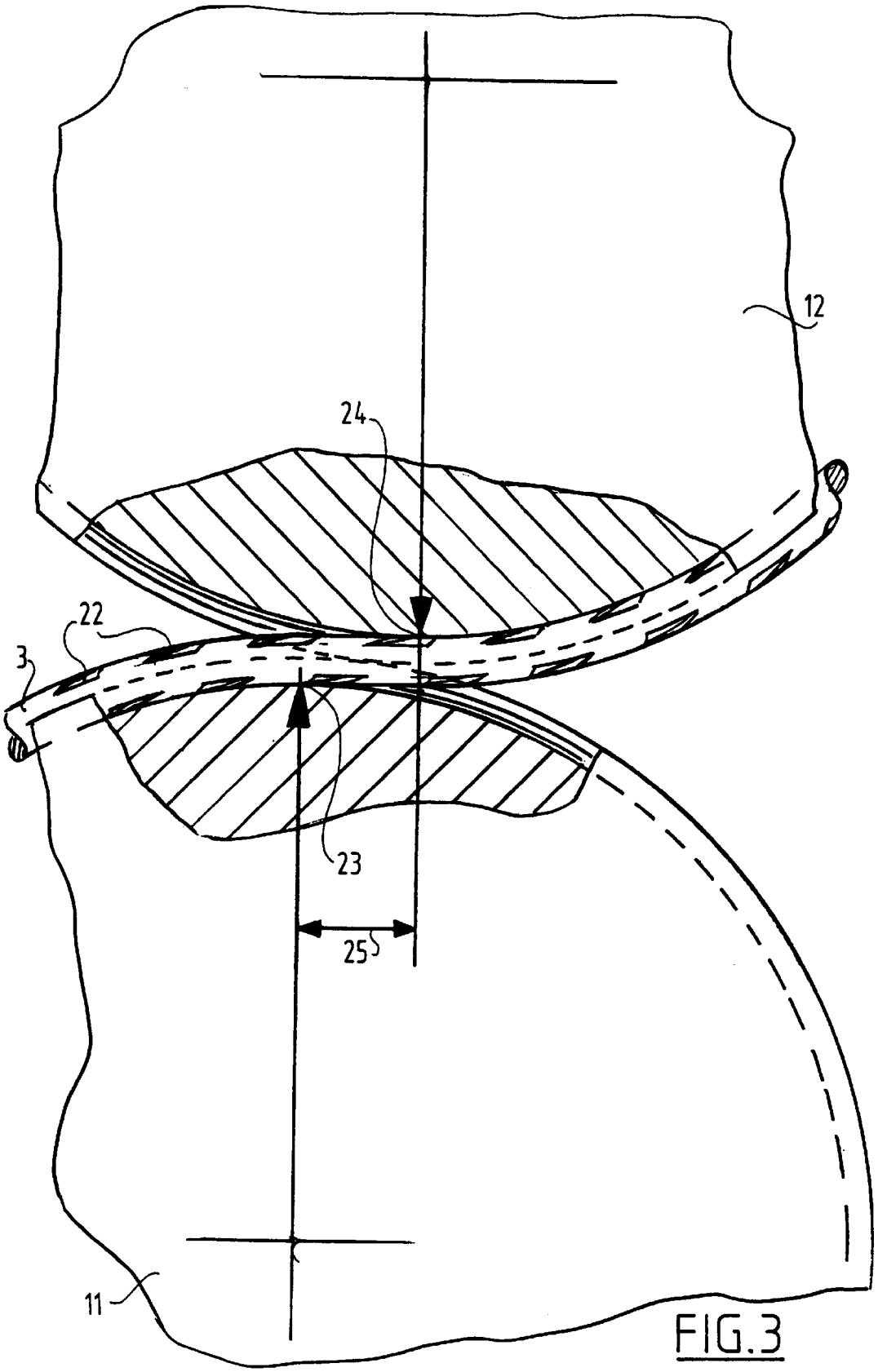
FIG. 3 shows on larger scale a variant of the device of FIG. 2.

FIG. 3 shows a variant. Herein the metal wire 3, which in roller cassette 6 is provided inter alia with indentations 22, is trained round the rollers 11 and 12 wherein in this case there is a transition distance between the points of contact 23 and 24. At the contact point 23 the metal wire leaves roller 11 and at contact point 24 it is trained round roller 12. This transition distance 25 between rollers 11 and 12 is in this case roughly equal to 2.5 times the metal wire diameter.

Figure 4:
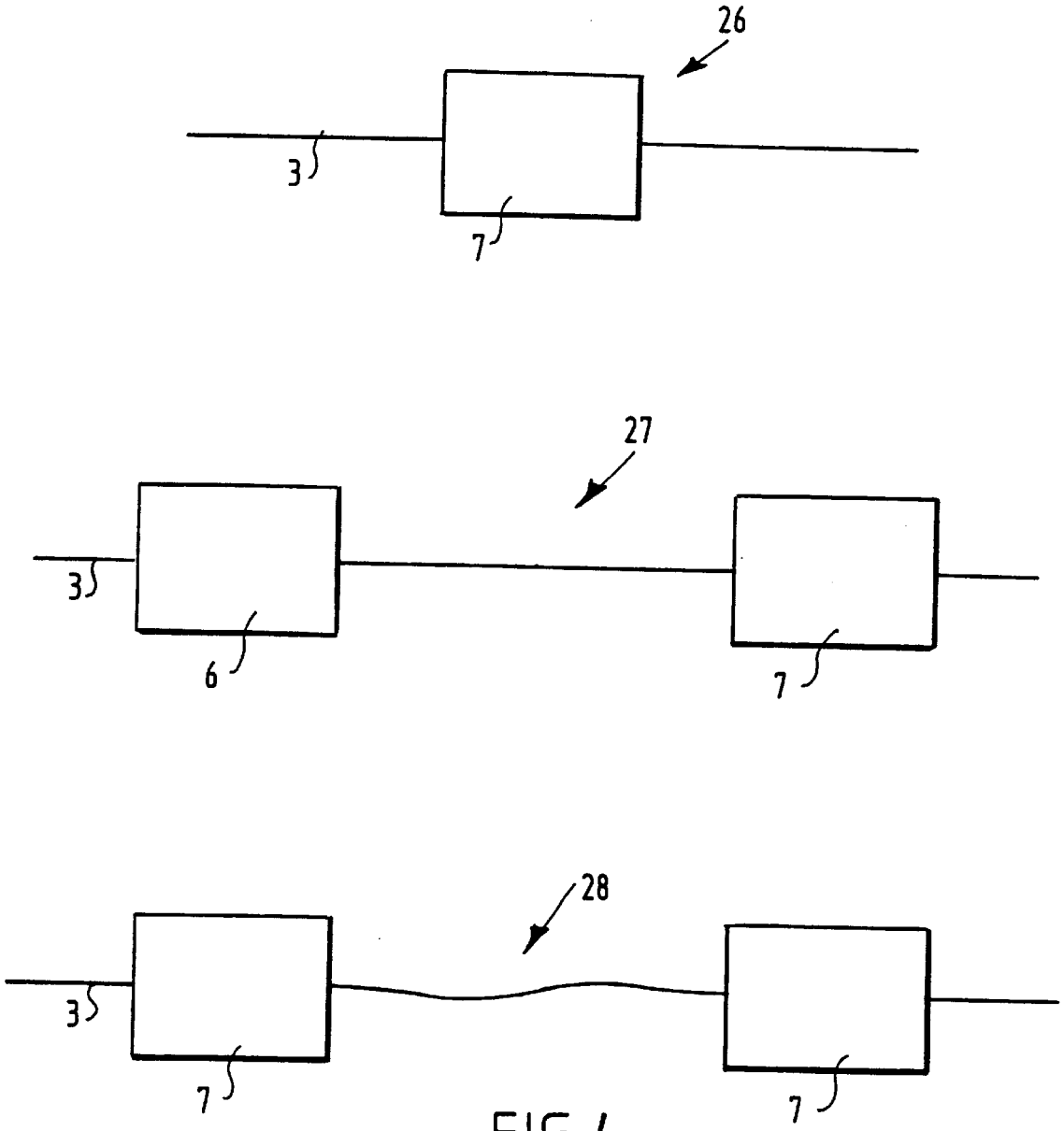
FIG. 4 shows a number of flow diagrams for devices for processing metal wire according to the invention.

Finally, FIG. 4 shows a number of devices for processing the metal wire 3. In device 26 the metal wire 3 is processed solely in cold flow unit 7 whereby a wire is obtained with an optimum stretching ductility.

In device 27 a roller cassette 6 and a cold flow unit 7 are connected successively as shown in FIG. 1. In this case separate transporting means can thus be omitted, while the wire can be stretched between the two units 6 and 7.

Finally, in the device 28 according to the invention two cold flow units 7, both of which are driven, are connected successively. In this case the transport between the two units 7 thus takes place without stretch being exerted on the metal wire.

I claim:

1. A cold flow unit for treating a metal wire, comprising at least three successive rollers and a rotation speed control connected to each of the rollers, wherein the rotation speed controls are configured to control roller rotation speed for each of the respective rollers subject to a desired deliverv speed of the metal wire, wherein the rollers are configured such that the metal wire is trained over a part of a roller periphery such that at a transition of the metal wire from one roller to a subsequent roller a transition distance between the points of contact is less than five times a diameter of the metal wire, and wherein the metal wire is stretched between the rollers such that tension in the metal wire decreases, tensile strength of the metal wire increases and ductility of the metal wire increases.

2. The cold flow unit as claimed in claim 1, wherein the transition distance is less than 4 times the metal wire diameter.

3. The cold flow unit as claimed in claim 1, wherein the transition distance is less than 2.5 times the metal wire diameter.

4. The cold flow unit as claimed in claim 1, comprising at least four successive rollers over which the metal wire is trained.

5. The cold flow unit as claimed in claim 1, wherein the rollers are configured such that there is friction contact between at least one roller and the metal wire.

6. The cold flow unit as claimed in claim 1, including a sensor for measuring the desired delivery speed.

7. The cold flow unit as claimed in claim 1, wherein the transition distance is less than 4 times the metal wire diameter.

8. A device for processing metal wire, comprising:

a roller cassette and subsequent thereto at least one cold flow unit having at least three successive rollers and a rotation speed control connected to each of the rollers, wherein the rotation speed controls are configured to control roller rotation steed for each of the respective rollers subject to a desired delivery speed of the metal wire, wherein the rollers are configured such that the metal wire is trained over a part of the roller periphery such that at a transition of the metal wire from one roller to a subsequent roller a transition distance between the points of contact is less than five times a diameter of the metal wire, and wherein the metal wire is stretched between the rollers such that tension in the metal wire decreases, tensile strength of the metal wire increases and ductility of the metal wire increases.

9. A device for processing metal wire, comprising:

at least two successive cold flow units each having at least three successive rollers and a rotation speed control connected to each of the rollers, wherein the rotation speed controls are configured to control roller rotation speed for each of the respective rollers subject to a desired delivery speed of the metal wire, wherein the rollers are configured such that the metal wire is trained over a part of the roller periphery such that at a transition of the metal wire from one roller to a subsequent roller a transition distance between the points of contact is less than five times a diameter of the metal wire, and wherein the metal wire is stretched between the rollers such that tension in the metal wire decreases, tensile strength of the metal wire increases and ductility of the metal wire increases.

10. The device as claimed in claim 9, wherein the first cold flow unit is not driven.

11. The device as claimed in claim 9, wherein both cold flow units are driven.

* * * * *

UNITED STATES PATENT AND TRADEMARK OFFICE

CERTIFICATE OF CORRECTION

PATENT NO. : 6,006,573

DATED : December 28, 1999

INVENTOR(S) : Jacobus L. Van Merksteijn

It is certified that error appears in the above-identified patent and that said Letters Patent is hereby corrected as shown below:

Title Page, [76] Inventor, address: "Veldolenweg" should read --Veldmolenweg--.

Column 3 Line 16, Claim 1, "deliverv" should read --delivery--.

Column 4 Line 6, Claim 8, "steed" should read --speed--.

Signed and Sealed this

Thirty-first Day of October, 2000

*Attest:*

*Attesting Officer*

Q. TODD DICKINSON

*Director of Patents and Trademarks*